US007261624B2

(12) United States Patent
Wedel et al.

(10) Patent No.: US 7,261,624 B2
(45) Date of Patent: Aug. 28, 2007

(54) PROTECTIVE COVER FOR A HAND-HELD CUT-OFF MACHINE

(75) Inventors: Christina Wedel, Bietigheim-Bissingen (DE); Klaus-Martin Uhl, Plochingen (DE); Maximilian Eberhardt, Esslingen (DE); Jurgen Erath, Stuttgart (DE); Joachim Hoffmann, Plochingen (DE); Rolf Ademes, Weinsheim (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 122 days.

(21) Appl. No.: 11/163,643

(22) Filed: Oct. 26, 2005

(65) Prior Publication Data

US 2006/0123638 A1 Jun. 15, 2006

(30) Foreign Application Priority Data

Oct. 29, 2004 (DE) ..... 10 2004 052 672
Sep. 16, 2005 (DE) ..... 10 2005 044 298

(51) Int. Cl.
*B24B 55/04* (2006.01)

(52) U.S. Cl. ..... 451/451; 30/390; 83/478

(58) Field of Classification Search ..... 451/451, 451/358, 457; 30/390, 391; 83/478, 490; 125/13.01, 13.03
See application file for complete search history.

(56) References Cited

U.S. PATENT DOCUMENTS

| | | | | |
|---|---|---|---|---|
| 4,532,841 | A * | 8/1985 | Stackhouse, Jr. | 83/102.1 |
| 4,576,073 | A * | 3/1986 | Stinson | 83/102.1 |
| 5,146,825 | A * | 9/1992 | Dehari | 83/397 |
| 5,940,976 | A * | 8/1999 | Soderqvist et al. | 30/390 |
| 6,279,442 | B1 * | 8/2001 | Chang | 83/397 |
| 6,874,400 | B2 * | 4/2005 | Johansson | 83/877 |
| 7,020,970 | B1 * | 4/2006 | Welch | 30/391 |
| 2004/0134076 | A1 * | 7/2004 | Moore et al. | 30/166.3 |
| 2005/0178011 | A1 * | 8/2005 | Moore et al. | 30/391 |

FOREIGN PATENT DOCUMENTS

| | | |
|---|---|---|
| DE | 295 08 950 | 9/1995 |
| GB | 305824 | 8/1928 |

* cited by examiner

*Primary Examiner*—Eileen P. Morgan
(74) *Attorney, Agent, or Firm*—Gudrun E. Huckett

(57) ABSTRACT

A protective cover for a cutting wheel of a hand-held cut-off machine driven by an internal combustion engine has a circumferential wall and two opposed sidewalls adjoining the circumferential wall. The circumferential wall and the two sidewalls are a monolithic component made of cast light metal. The circumferential wall in a circumferential direction has at least over sections thereof a first integral thicker portion. The two sidewalls are thinner than the first integral thicker portion. Preferably, the protective cover is made of diecast magnesium.

25 Claims, 8 Drawing Sheets

PROTECTIVE COVER FOR A HAND-HELD CUT-OFF MACHINE

BACKGROUND OF THE INVENTION

The invention relates to a protective cover for a cutting wheel of a hand-held cut-off machine driven by an internal combustion engine, wherein the protective cover comprises a circumferential wall and two opposed sidewalls adjoining the circumferential wall.

Small hand-held circular saws are known in which the circular saw wheel is enclosed relative to the operator by a protective cover made of cast light metal. The protective cover provides a contact protection and serves for catching or removing by suction the relatively lightweight sawdust. The protective cover as a whole is exposed only to minimal operating loads.

When performing a cut in stone or similar materials, hand-held cut-off machines generate large amounts of grinding dust that can also be mixed with coarse particles. For collecting the grinding dust, the particles, and optionally also sparks that are generated, a protective cover is provided that partially covers the cut-off wheel of the cut-off machine.

In particular in the case of large cut-off machines that are driven by an internal combustion engine and have cutting wheels having a diameter, for example, of 300 mm or 350 mm, a significant driving power is required for performing a cut. The great power output causes large amounts of dust, particles, sparks or the like that are swirled at extremely high kinetic energy and thrown against the inner side of the protective cover of the cutting wheel. Making things worse is the fact that the stone or cement dust or the like has a high abrasive effect that, in combination with the great kinetic energy, leads to a correspondingly high wearing load on the protective cover.

In addition to be thus resulting requirement of a high wear resistance, the weight of the cover is of particular importance. Cut-off machines having an internal combustion engine as the drive motor belong to a size class that, based on the configuration, have a higher inherent weight in comparison to smaller devices. In order to enable, in spite of this, excellent handling in the case of manually performed cutting tasks, a lightweight construction for compensation of the high concept-based basic weight is a primary objective.

DE 295 08 950 discloses that the protective cover of a cut-off machine of the aforementioned kind made of aluminum is correspondingly lightweight but does not fulfill the requirements in regard to a long service life and wear resistance. As a solution to this problem, the aforementioned document proposes a two-part protective cover that is joined of aluminum sheet and has a wear strip riveted into its circumferential wall. The rivet connection secures the wear strip and serves at the same time for providing a connection of the two cover parts made of aluminum sheet. A cover of such a configuration is comparatively lightweight and has also an improved wear resistance. The service life however is limited because of the rivet heads that project into the interior of the cover and are exposed to the grinding dust and thus to abrasion.

The invention has the object to provide a protective cover for a cutting wheel of a hand-held cut-off machine which provides improved wear resistance while being made of a lightweight construction.

SUMMARY OF THE INVENTION

This object is solved in accordance with the present invention in that the circumferential wall and the two sidewalls cast as a monolithic component of light metal form the protective cover, wherein the circumferential wall in the circumferential direction has at least over sections thereof an integral thicker portion and the two sidewalls are thinner in comparison to the thicker portion of the circumferential wall.

A protective cover for a cutting wheel is proposed that has at its circumferential wall in the circumferential direction at least over sections thereof an integral thicker portion and has sidewalls that, in comparison thereto, are thinner, wherein the protective cover comprising the circumferential wall, the thicker portion provided over sections thereof, and the thinner sidewalls are formed as a monolithic cast light-metal part. The thicker portions that are arranged over sections of the circumferential wall can be provided in a targeted fashion at locations of particularly high abrasive action while the other sections of the protective cover are thin-walled and lightweight. In the area of the thicker portions abrasion is accepted deliberately; however, a correspondingly long service life is still enabled as a result of the thicker portion. The purposeful thin-walled configuration of the sidewalls and of other cover sections that are exposed to reduced wear loads enables in combination with the monolithic cast light-metal part a configuration free of joints that, as a whole, is mechanically stable and, even when taking into account the thicker portions that are exposed to wear, has as a whole a reduced weight in comparison to conventional configurations. The thicker portions that are formed as integral parts by casting are worn slowly over an extended period of time of the service life wherein, because of the lack of separate connecting elements, the integrity of the protective cover remains essentially unaffected by the state of wear of the thicker portion. In particular, magnesium diecasting has been found to be beneficial for the manufacture of the protective cover according to the invention; it provides an improved ratio of wear resistance to cover weight.

In an advantageous further embodiment, the entry area of the circumferential wall is thicker relative to a central area arranged downstream in the circumferential direction. It was found that the cutting wheel when performing its cutting movement as it moves through the cut collects a corresponding amount of cutting dust. During the course of further rotational movement, the corresponding section of the cutting wheel passes the entry area of the protective cover and most of the cutting dust is then thrown off across the circumferential section of the entry area. The central area that is arranged downstream in the circumferential direction is loaded only minimally. A thicker portion purposefully provided in the entry area leads to the desired wear resistance while the central area of the circumferential wall is sufficiently wear-resistant without having a thicker portion and while having minimal weight.

In an advantageous further embodiment, the thicker portion projects away from the contour of the circumferential wall into the interior of the protective cover and is curved in particular convexly into the interior. The area of the thicker portion that projects into the interior is positioned in alignment with the cutting wheel. The corresponding configuration is based on the recognition that an increased abrasion is to be expected only in direct alignment with the cutting wheel across a correspondingly narrow area. In addition or as an alternative, it can be advantageous that the thicker portion curves outwardly away from the contour of the circumferential wall and in particular forms an alignment mark for the cutting wheel. The claimed configuration of the thicker portion provides in a targeted way in the alignment area of the cutting wheel a sufficient material thickness that is sufficient for a long service life. In this connection, the thicker portion is narrow in the transverse direction and has a minimal weight as a whole.

In an expedient embodiment, the sidewalls extend in the radial direction at least over sections thereof slantedly toward the adjoining circumferential wall. Advantageously, in this connection the sidewalls have in the area adjoining the circumferential wall a radius of curvature that becomes smaller in the radial direction. In a related expedient embodiment, the sidewalls and the circumferential wall pass flowingly into one another in a radially extending cross-section and have in particular an approximately elliptical contour. During the cutting operation, the operator of the cut-off machine looks onto the circumferential wall of the protective cover approximately in the radial direction without being able to see the cutting wheel itself. As a result of the claimed configuration, the protective cover is very slim especially in its circumferential area. This facilitates a position-precise guiding of the cut-off machine along the predetermined cutting line. At the same time, on the inner side of the protective cover an improved guiding action for the cutting dust is provided. The flowing contour transitions prevent deposits or caking. Particles that are thrown off laterally of the cutting wheel impact in the circumferential area at a flat angle onto the slantedly positioned sidewalls or onto the outwardly located curved transition area. The flat impact angle, optionally in combination with multiple reflection, results in low impact energy. The wear is minimal even for a very thin-walled configuration. At the same time, the curved cross-sectional contour contributes to shape stability and thus to the load capacity of the protective cover.

In an advantageous embodiment, the circumferential wall has an integral radially outwardly projecting thicker portion. This thicker portions enables a targeted attachment of components such as, in particular, a handle for positional adjustment of the protective cover. By means of the thicker portion a targeted force introduction into the protective cover is possible. As a result of the cast embodiment, flowing transitions into adjoining thin-walled areas are possible without creation of force peaks.

In an expedient further embodiment, in a vertical direction that is predetermined by the central area a spacing between the two sidewalls tapers starting at the hub up to the circumferential wall. The sidewalls are positioned at a slant to one another at an angle and converge toward one another in the direction toward the circumferential wall. This configuration, like the expedient embodiment with steps extending transversely to the vertical direction, also contributes to a slim appearance with excellent guiding precision of the cut-off machine. The steps provide the sidewalls with an appropriate shape stability that enables a further reduction of the required wall thickness. In particular in a configuration in which one of the steps extends at least approximately radially outwardly to the thicker attachment portion, this stepped configuration can also be used as a rest or mounting aid for auxiliary parts such as a handle or the like. At the same time, the claimed shape takes into consideration the requirements of the casting technology in particular with regard to easy removal from the mold.

As a whole, in addition to increasing the wear resistance, the claimed embodiment increases also the vibration resistance and fatigue resistance as a result of the contour-based increased shape stability. The cover can safely catch a bursting cutting wheel, even if comprised of a very light-weight configuration.

At least one of the sidewalls has advantageously in its hub area an integral annular fastening flange that is provided with window-like depressions distributed, in particular, in the circumferential direction. The monolithic integration of the fastening flange into the sidewall leads to a highly loadable attachment of the protective cover on the cut-off machine. The window-like depressions distributed in the circumferential direction provide a structure of webs and thin-walled wall sections that, while having minimal weight, are stiff and strong. At the same time, the local material strength of the light-metal cast is minimal even for a thick outer contour of the fastening flange. Excessive shrinkage upon cooling in the casting mold is prevented.

The ratio between load capacity and weight is further improved in that the fastening flange passes with a rounded contour, and in particular an elliptical contour, into the adjoining sidewall.

Advantageously, at least one partial area of the surface of the protective cover facing the interior has an inner coating that is generated in particular by means of an electrochemical process. The inner coating prevents corrosion when wet cutting and enhances the wear protection effect of the circumferential thicker portions.

In an expedient further embodiment, the circumferential wall is provided in its entry area with a wear protection that is embodied as a separate part. When dropping below the predetermined wear limit, the separate configuration of the wear protection enables an easy exchangeability without having to replace the entire protective cover. Also, a material can be selected for the wear protection that is different from that of the protective cover and is particularly wear-resistant.

Advantageously, the wear protection is arranged on the side of the circumferential wall that faces the interior of the protective cover and encloses in particular a leading edge adjoining the entry area. The wear protection is in this way limited in its extension locally to the areas where the increased wear is to be expected. While an effective protection is provided, the additional weight is minimal.

Preferably, the wear protection is made of sheet steel and in particular is attached by snapping into place in an elastically springy way in the area of the circumferential wall. The wear protection can be produced, mounted and optionally exchanged cost-effectively while providing an excellent effectiveness.

BRIEF DESCRIPTION OF THE DRAWINGS

Embodiments of the invention will be explained in the following in more detail with the aid of the drawing.

DESCRIPTION OF PREFERRED EMBODIMENTS

Figure 1:
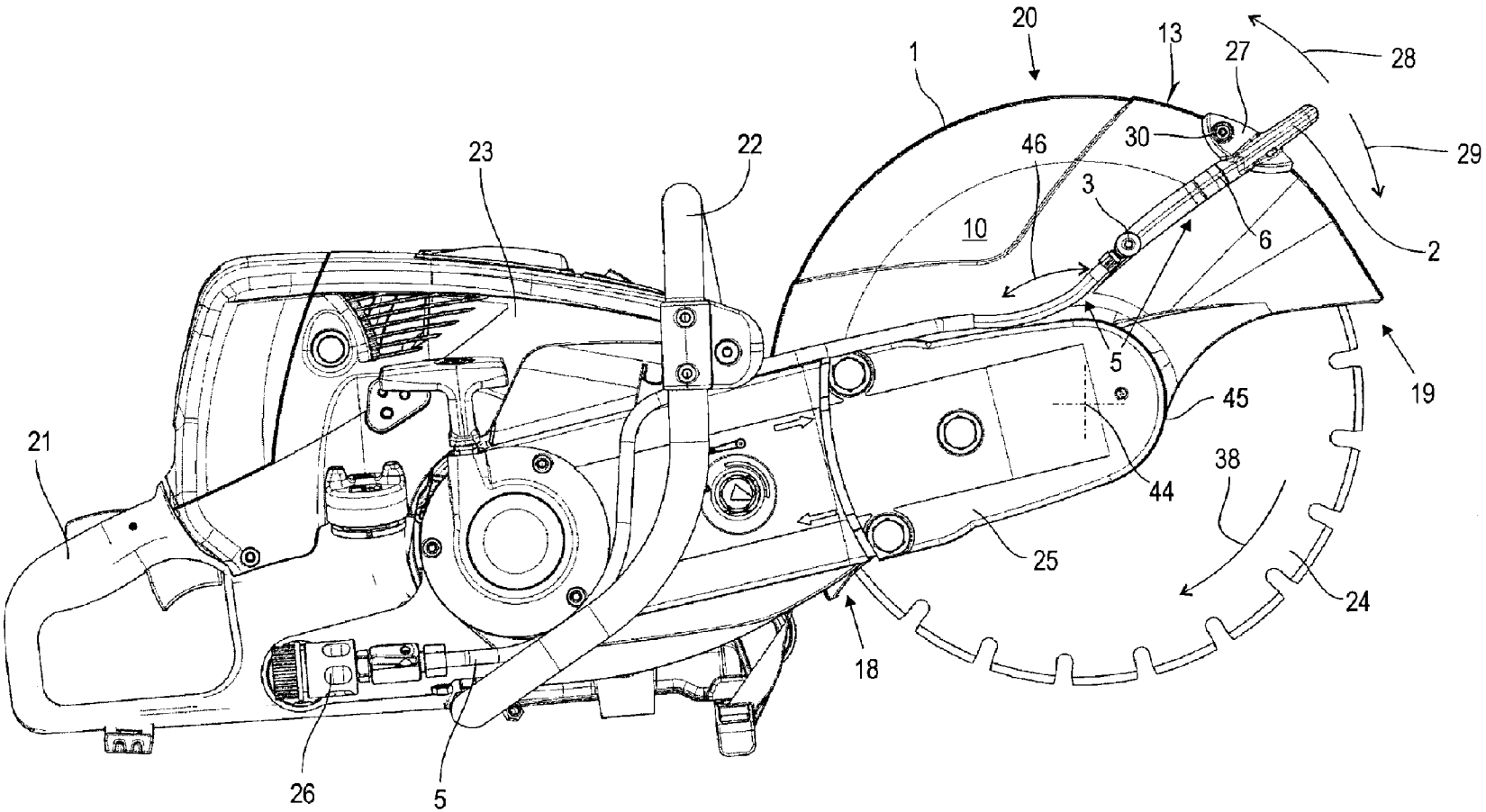
FIG. 1 shows a side view of a hand-held cut-off machine with a protective cover embodied as a diecast magnesium part.

FIG. 1 shows in a side view a cut-off machine with a motor housing 23 in which an internal combustion engine, not shown in detail, is arranged as a drive motor for a cutting wheel 24. A rear handle 21 and a front handle 22 attached to the motor housing 23 are provided for guiding the cut-off machine by hand. The cutting wheel 24 is rotatingly driven in a rotational direction indicated by arrow 38 by the drive motor, not illustrated, by means of a belt drive 25 about an axis of rotation 44.

A protective cover 1 is attached to the hub area 45 of the cutting wheel 24; it covers the cutting wheel 24 laterally and in the area of its circumference about an angular range of approximately 180°. The protective cover 1 is manufactured of cast light metal and is provided at the surface facing the interior 33 (FIG. 4) with a corrosion-resistant and abrasion-resistant electrochemically applied coating. Relative to the rotational direction 38 of the cutting wheel 24, the protective cover has in the area of its circumferential wall 13 an entry area 18, an exit area 19 as well as an intermediate central area 20.

The protective cover 1 is attached in an adjustable way and, as needed, can be pivoted in the direction of double arrow 46 about the hub area 45 or about the axis of rotation 44 into a desired operating position. For adjusting the pivot position, a handle 2 is attached to the protective cover 1 with which the manual forces required for adjustment can be applied.

Figure 2:
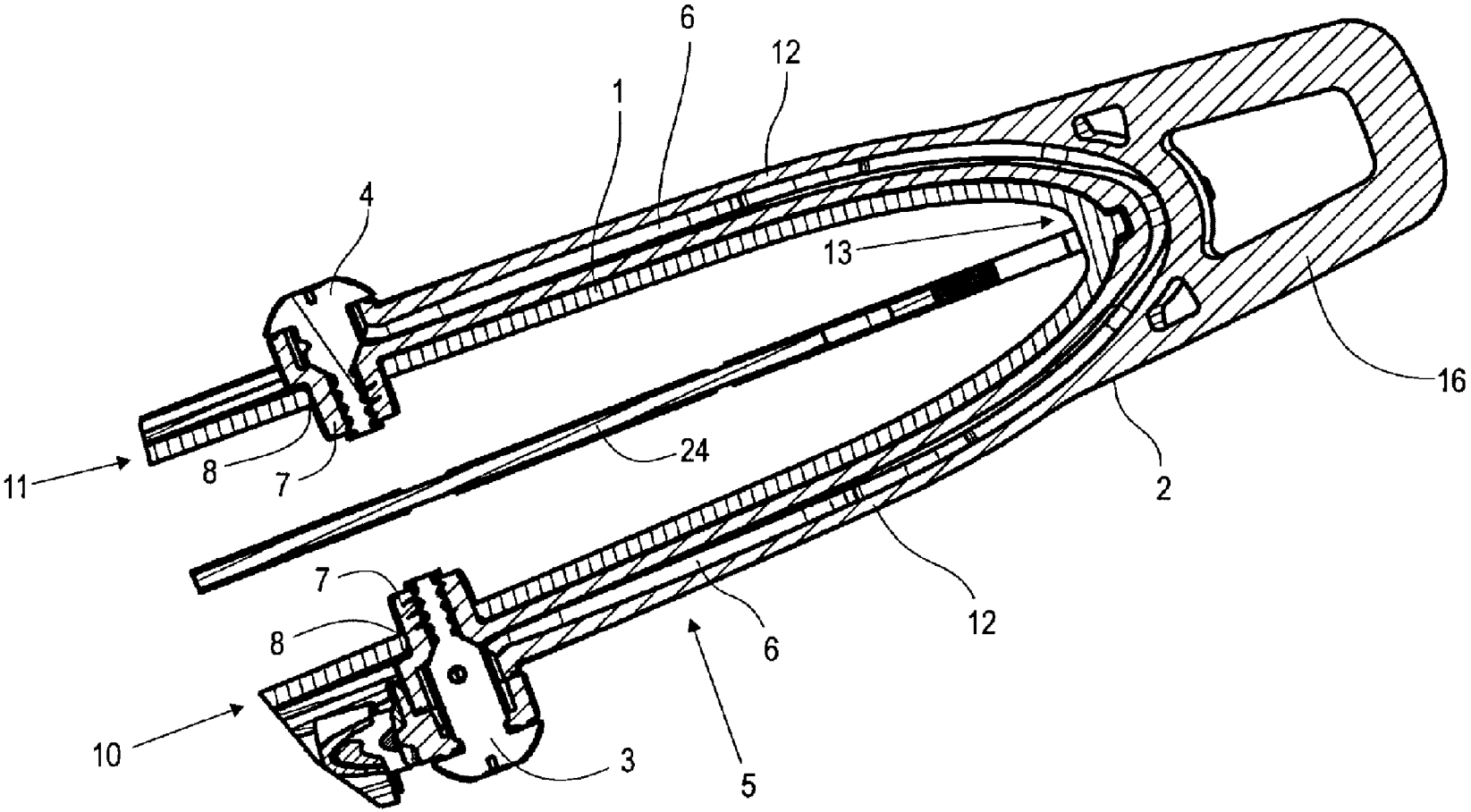
FIG. 2 is in an enlarged detail view in section of the protective cover according to FIG. 1 in the area of a handle with integrated water supply.

In one sidewall 10 of the protective cover 1, an injection nozzle 3 for cooling liquid is arranged. A further injection nozzle 4, not illustrated but to be described in the following in more detail in connection with FIG. 2, is arranged on the opposed sidewall 11. A supply line 5 is provided at the intake side with a hose coupling 26 and extends to the injection nozzle 3. A line section 6 of the supply line 5 extends from the first injection nozzle 3 through the handle 2 to the second injection nozzle 4 (FIG. 2). For example, water as a cooling liquid can be supplied through the supply line to the injection nozzles 3, 4 and from there guided onto the cutting wheel 24 as a cooling agent or as a dust binding agent.

The handle 2 is attached by means of the injection nozzle 3 and the opposed injection nozzle 4, illustrated in FIG. 2, to the protective cover 1. The handle 2 has moreover an areal contact section 27 positioned circumferentially relative to the protective cover 1; the handle 2 rests by means of the contact section 27 in the area of the circumferential wall 13 on the protective cover 1. By means of the contact section 27 the handle 2 is pivotably supported in a pivot direction indicated by arrow 29 about the injection nozzles 3, 4. As a rest in the opposite direction that is indicated by arrow 28, a positive locking attachment secured by screw 30 is provided; this will be explained in more detail in connection with FIG. 9 to 11.

FIG. 2 shows in an enlarged cross-sectional illustration a detail of the protective cover 1 according to FIG. 1 in the area of the handle 2. The two injection nozzles 3, 4 are arranged symmetrically to one another and opposite one another on both sidewalls 10, 11 of the protective cover 1. The handle 2 has a U-shaped line part 12 with which the handle 2 is guided along a lateral surface 10 across the circumferential wall 1 and along the additional sidewall 11. The two injection nozzles 3, 4 are arranged at the free legs of the U-shaped line part 12 and are integrated into the line part 12.

The line section 6 extends from the first injection nozzle 3 to the second injection nozzle 4 and is completely integrated into the U-shaped line part 12 of the handle 2. The handle 2 thus provides a flow-conducting fluid connection between the first injection nozzle 3 and the sidewall 10 to the second injection nozzle 4 on the opposed sidewall 11. The line section 6 of the supply line 5 is guided in accordance with the shape of the U-shaped line part 12 along the sidewalls 10, 11 and about the circumferential wall 13. Instead of the handle 2 it is also possible to provide a bow without handle function for receiving the line section 6.

The handle 2 is embodied as a plastic part and produced by gas injection technology (GIT) for forming the integrated line section 6. Radially outwardly of the circumferential wall 13, a ring-shaped bow handle 16 that points outwardly is formed as an integral part of the handle 2. The free legs of the U-shaped line part 12 each have an inwardly oriented hollow pin 7 formed as an integral part; by means of the pins the handle 2 can be positive-lockingly snapped into place into opposed openings 8 of the protective cover 1. The two openings 8 are formed by casting in the protective cover 1. The two hollow pins 7 receive the injection nozzles 3, 4 that are oriented inwardly against the cutting wheel 24. The U-shaped line part 12 of the handle 2 is positioned in the mounted state on the lateral, radially extending steps 17 (FIG. 3) of the protective cover 1.

Figure 3:
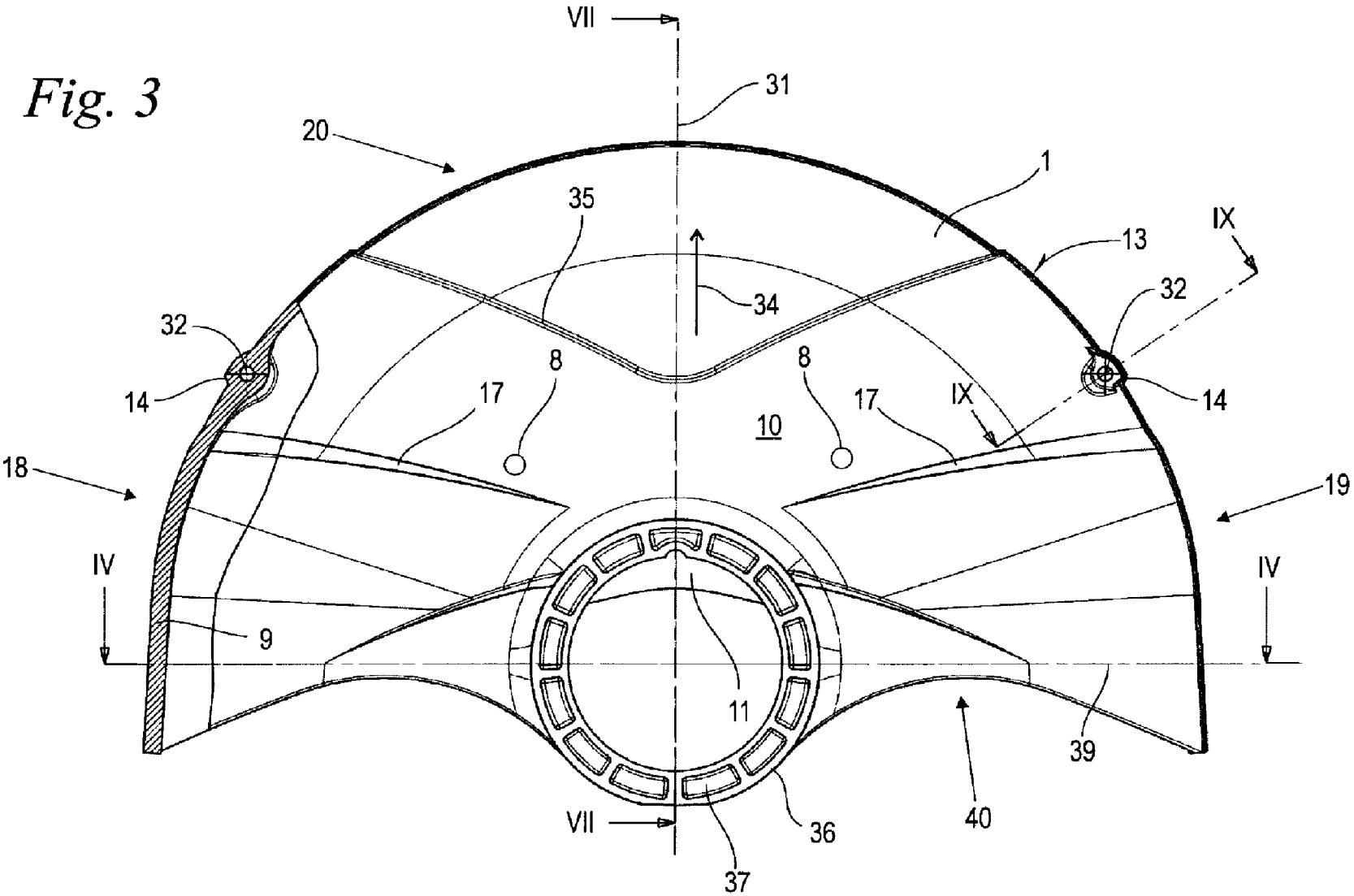
FIG. 3 is an enlarged illustration showing details of the protective cover of the cut-off machine according to FIG. 1.

FIG. 3 shows an enlarged illustration of the protective cover 1 according to FIG. 1 made of a cast light metal; in the illustrated embodiment, diecast magnesium is used. The protective cover 1 is a monolithic diecast part in which the sidewalls 10, 11, the circumferential wall 13, as well as monolithic thicker portions 9, to be described in the following in more detail, are integrated unitarily.

The protective cover is symmetric to a center line 31. Centrally at the bottom of the sidewall 10 an annular fastening flange 36 is formed as a monolithic part; it has window-like depressions 37 distributed in the circumferential direction. The opposed sidewall 11 has no such fastening flange 36. Instead, a one-sided attachment of the protective cover 1 in the hub area 45 (FIG. 1) by means of fastening flange 36 is provided. The symmetric configuration enables a turned left or right attachment of the protective cover 1, as needed.

In the direction of the center line 31 in the downward direction, the protective cover 1 has an open side 40 from which the cutting wheel 24 (FIG. 1) projects radially in the mounted state. Opposite the open side 40 the central area 20 of the protective cover 1 is located. Starting at the open side 40 and extending through the central area 20 along the center line 31, a vertical direction indicated by arrow 34 is defined.

Relative to the rotational direction 38 of the cutting wheel 24 (FIG. 1), the protective cover 1 has an entry area 18; the cutting wheel 24 moves first into this area for the given rotational direction 38. In the rotational direction 38, the central area 20 follows the entry area 18 and downstream thereof the exit area 19 is arranged. As a result of the symmetric configuration, the entry and exit areas 18, 19 are identical.

The entry area 18 of the protective cover 1 is partially illustrated in section showing that the circumferential wall 13 is provided across sections of the entry area 18 with a first integral thicker portion 9. In the illustrated longitudinal section, the circumferential wall is thus thicker in this area than in the central area 20. When mounting the protective cover 1 in a position rotated about the center line 31, the exit area 19 that, because of the symmetric configuration, is also provided with a corresponding thicker portion 9, becomes the entry area 18.

The circumferential wall 13 has symmetrically to the center line 31 on either side a second integral thicker portion 14 that projects radially outwardly and also inwardly; a screw hole 32 extends transversely through it, respectively. The thicker portion 14 is integrally formed by casting on the circumferential wall 13 and separates the entry and exit areas 18, 19 or the thicker portion 9 from the comparatively thin-walled central area 20 that is not reinforced. The entry and exit areas 18, 19 extend about an angle range of approximately 30° to 45°.

On either side of the center line 31 a step 17 that extends approximately radially and transversely to the vertical direction 34 is formed on the sidewall 10, 11, respectively. The step 17 extends from an inner location to an outer location approximately in the direction of the openings 8 and into the vicinity of the outer thicker portions 14. In addition to a shaped reinforcement of the sidewalls 10, 11 by means of the steps 17 a positive-locking rest for the handle 2 (FIG. 1) or for its U-shaped line part 12 (FIG. 2) is provided. The steps 17 provide together with the openings 8 and the thicker portions 14 with the screw holes 32 a positional fixation of the handle 2 (FIG. 1).

In the central area 20, a further step 35 extending transversely to the vertical direction is provided on the sidewalls 10, 11, respectively; it has approximately a V-shaped course and is provided for further reinforcement of the sidewalls 10, 11.

Figure 4:
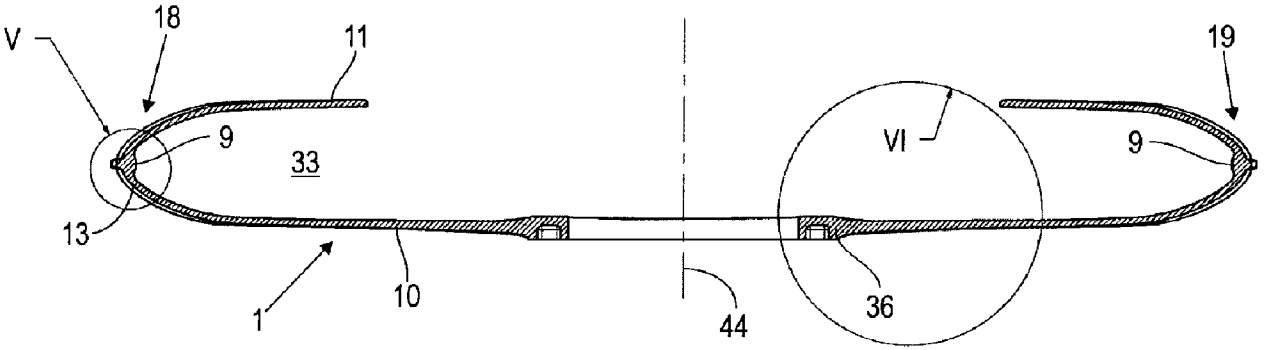
FIG. 4 is a section illustration of the protective cover along the transversely extending section line IV-IV illustrated in FIG. 3.

FIG. 4 provides in a section view of the protective cover along the transversely extending section line IV-IV illustrated in FIG. 3 an overview of the relative position of the sidewalls 10, 11 and of the circumferential wall 13. In this section direction, the sidewalls 10, 11 extend near the axis parallel to one another and at a right angle to the axis of rotation 44. By employing the axis of rotation 44 as a symmetry line for the instant illustrated section view, the sidewalls 10, 11 converge in their radially outwardly positioned section at a slant angle toward the adjoining circumferential wall 13. Starting at their parallel extending area, radially farther outwardly an inwardly oriented curvature of the sidewalls 10, 11 is provided whose radius of curvature becomes smaller radially outwardly and in this way describes an approximately elliptical contour. The sidewalls 10, 11 have a flowing transition from their radially inwardly positioned parallel extending area into the aforementioned elliptical contour into the circumferential wall 13 wherein the circumferential wall 13 is located in the area of the narrowest radius of curvature. The sidewalls 10, 11 and the circumferential wall 13 enclose an interior 33.

Figure 5:
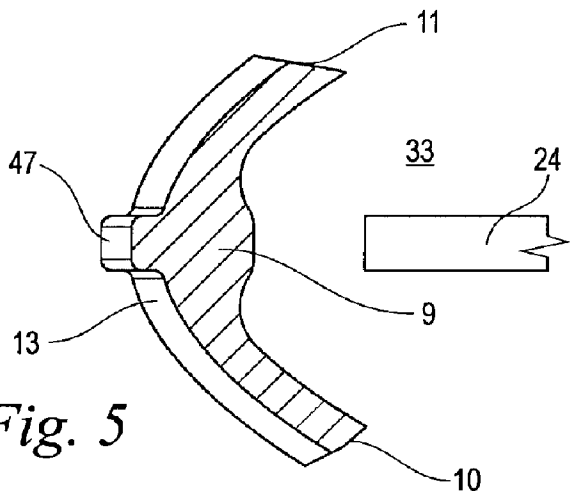
FIG. 5 shows in an enlarged section illustration the detail V of FIG. 4 showing details of the inwardly curved thicker portion.

In the oppositely positioned entry area 18 and exit area 19, the indicated thicker portion 9 is provided, respectively, that is shown as detail V in the detail illustration of FIG. 5. The thicker portion 9 projects from the contour of the circumferential wall 13 into the interior 33 of the protective cover 1 (FIG. 4). It is designed such that it curves convexly into the interior 33 wherein the area of greatest thickness or of convex curvature approximately matches the thickness of the cutting wheel 24. The thicker portion 9 also curves outwardly away from the contour of the circumferential wall 13 and forms an external alignment mark 47 for the cutting wheel 24 by means of which the operator can precisely position the cutting wheel 24 that is covered by the protective cover 1 for performing a cut with the cutting wheel 24. The thicker portion 9 is arranged centrally in the circumferential wall 13 wherein a relative positioning in alignment with the cutting wheel 24 is provided. Laterally relative to the area of the cutting wheel 24, the inner area of the thicker portion 9 first has a convexly rounded flowing transition and then a concavely rounded flowing transition into the lateral areas of the circumferential wall 13 and the sidewalls 10, 11.

The illustration according to FIGS. 3, 4, and 5 also shows that in addition to the circumferential wall in the central area 20, the sidewalls 10, 11 are also significantly thinner in comparison to the areas with the thicker portion 9 and have only approximately one-third of the thickness of the thicker portion.

Figure 6:
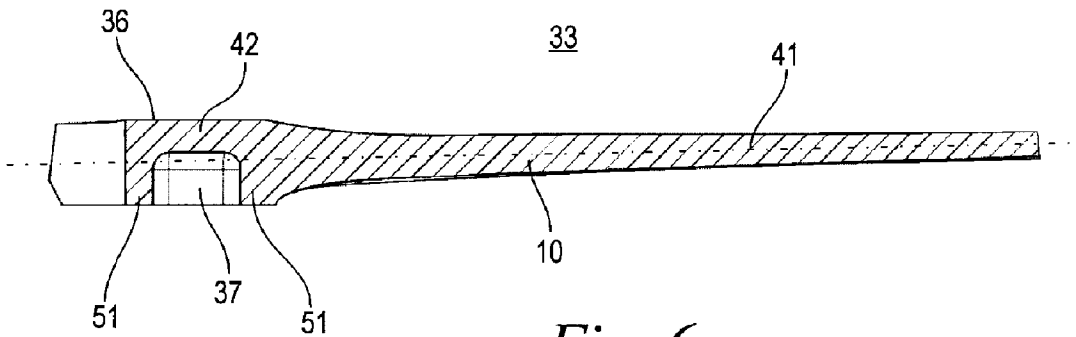
FIG. 6 shows in an enlarged section illustration the detail VI of FIG. 4 showing details regarding the shape of the fastening flange and its transition into the sidewall.

FIG. 6 shows in an enlarged section view the detail VI of FIG. 4 illustrating details in regard to the configuration of the fastening flange 36 and its transition into the sidewall 10. In the illustrated section view, the sidewall 10 extends approximately along a wall axis 41 that is perpendicular to the axis of rotation 44 (FIG. 4). The wall thickness decreases along the wall axis 44 in the radial outward direction. In the radial inward direction, the wall thickness of the sidewall 10 increases in both transverse directions relative to the wall axis 41 until it reaches the thickness of the fastening flange 36. In the illustrated section view, the fastening flange 36 has an elliptically rounded transition into the sidewall 10.

The illustrated section view also shows that the window-like depressions 37 are not open but are closed by thin wall sections 42 relative to the interior 33. Accordingly, a grid structure is formed that is comprised of thin wall sections 42 as well as of webs 51 extending in the circumferential direction or in the radial direction.

Figure 7:
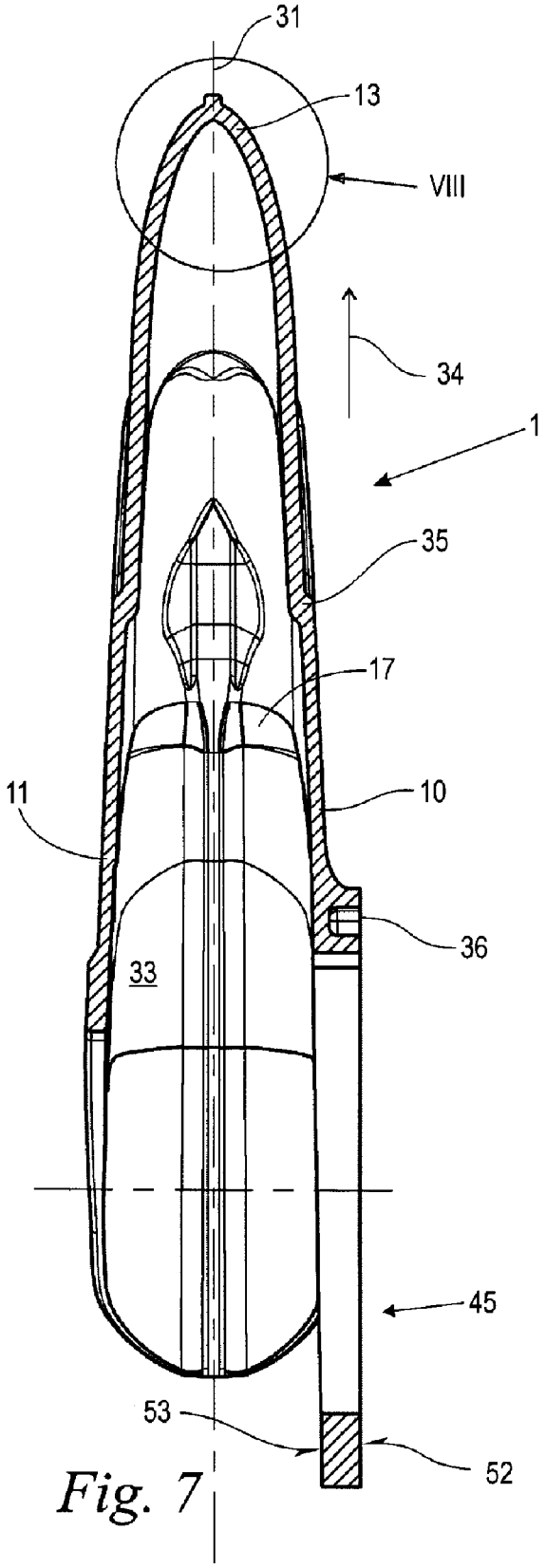
FIG. 7 is a section view of the protective cover along the section line VII-VII illustrated in FIG. 3 showing details regarding the configuration of the sidewalls in the vertical direction.

FIG. 7 shows a section illustration of the protective cover 1 along the section line VII-VII illustrated in FIG. 3 with details regarding the shape of the sidewalls 10, 11 in the vertical direction 34. An outer surface 52 of the fastening flange 36 is positioned parallel to the center line 31. The outer surface 52 serves for positional fixation of the protective cover 1 relative to the cut-off machine and its cutting wheel 24 (FIG. 1). The inner surface 53 of the fastening flange 36 facing the interior 33 extends relative to the vertical direction 34 at a slant inwardly wherein its slant angle is approximately 1°, for example. The part of the sidewall 10 adjoining in the radially upward direction is also inwardly slanted toward the center line 31, as is the opposed sidewall 11. The slant is selected such that the spacing between the two sidewalls 10, 11, beginning at the hub area 45, tapers toward the circumferential wall 13 in the vertical direction 34. Near the circumferential wall 13 the two sidewalls 10, 11 have an elliptical curvature in accordance with the outer area shown in FIG. 4. Radially farther inwardly, a cross-section of the two sidewalls 10, 11 extends approximately linearly wherein the straight extension is interrupted by the steps 35, 17. Within their straight extension, the sidewalls 10, 11 are slanted approximately at an angle of 2.5° relative to the center line 31. Relative to the vertical direction 34, the steps 35, 17 are stepped inwardly toward the interior 33. As a whole, across the entire cross-section along the center line 31 extending in the vertical direction 34, a spacing that continuously decreases up to the circumferential wall 13 results for the two sidewalls 10, 11 relative to one another or relative to the center line 31.

Figure 8:
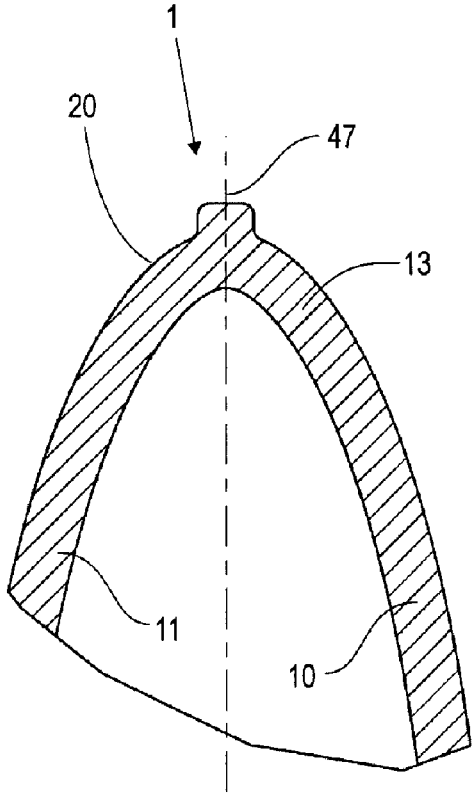
FIG. 8 shows in an enlarged section illustration the detail VIII of FIG. 7 showing details regarding the shape of the circumferential wall in the central area.

FIG. 8 further shows the detail VIII according to FIG. 7 in an enlarged illustration; it is shown that the sidewalls 10, 11 pass elliptically rounded into the circumferential wall 13. In accordance with the section view extending through the central area 20, only an exterior thicker portion 9 is provided in contrast to the illustration of FIG. 5. The wall thickness of the sidewalls 10, 11 and of the circumferential wall 13 remains essentially constant. Only the alignment mark 47 is provided in the central area 20. As a whole, the alignment mark 47 extends about the entire circumferential wall 13.

Figure 9:
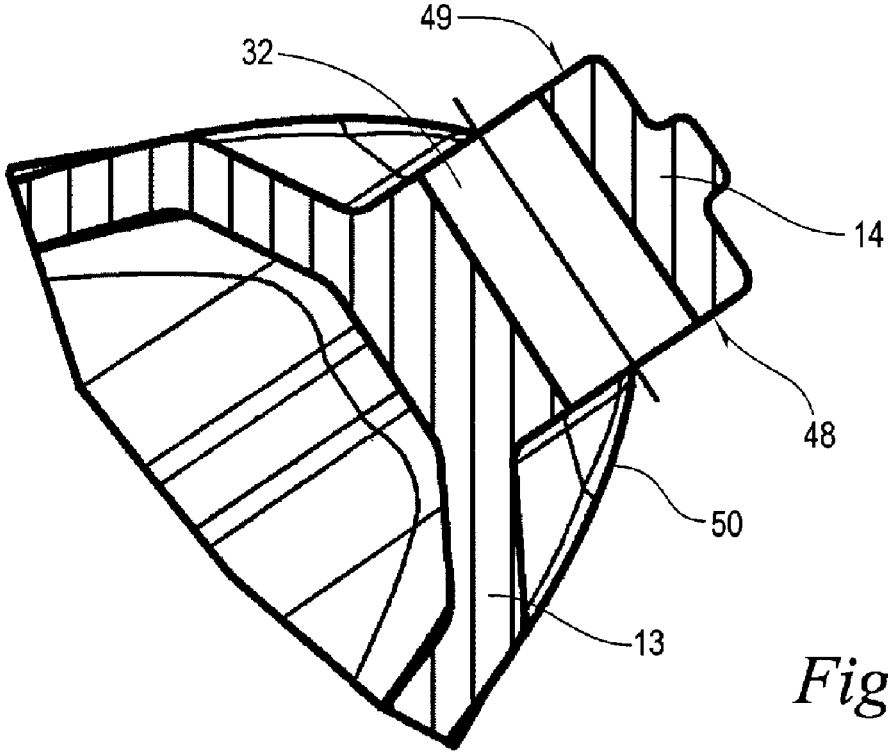
FIG. 9 is an enlarged section illustration of the protective cover along the section line IX-IX illustrated in FIG. 3 with details of the thicker portion for attachment of the handle.

FIG. 9 shows an enlarged section illustration of the protective cover 1 along the line IX-IX shown in FIG. 3. The thicker portion 14 is provided with two parallel lateral surfaces 48, 49 that extend radially outwardly away from the circumferential wall 13. The circumferential wall 13 in the area of the thicker portion 14 is inwardly angled relative to its usual contour 50 thus causing a radial extension of the thicker portion 14 toward the exterior as well as toward the interior relative to the remaining contour of the circumferential wall 13; this will be explained in more detail in connection with FIG. 11. The lateral surfaces 48, 49 are thus positioned approximately within the contour 50 up to the central axis of the transversely extending screw hole 42.

Figure 10:
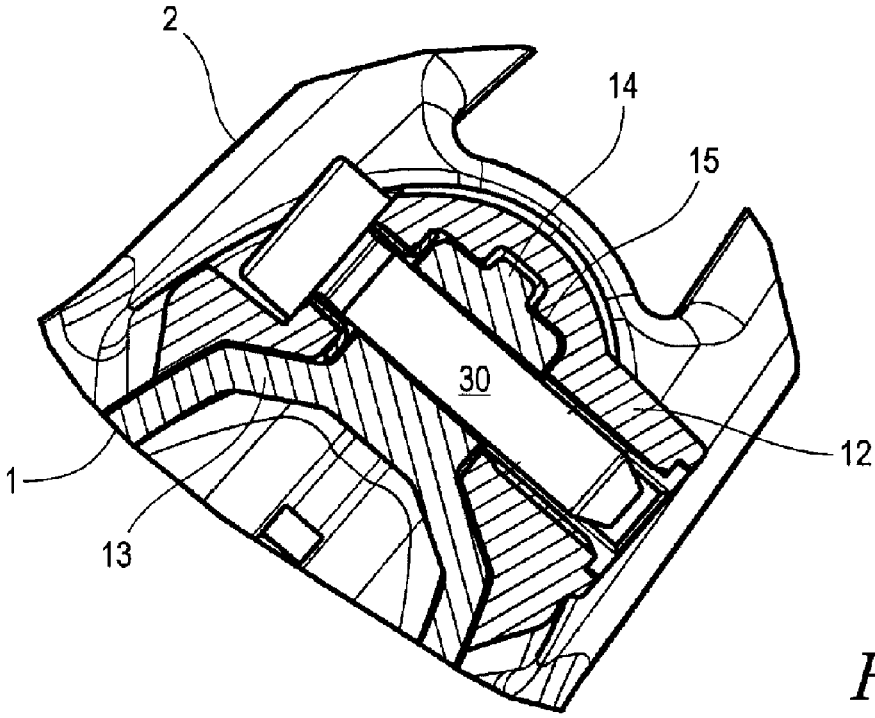
FIG. 10 shows the thicker portion according to FIG. 9 with a handle that is mounted and screwed on in accordance with FIG. 1.

In FIG. 10, the arrangement according to FIG. 9 is illustrated together with the mounted handle 2. Accordingly, the thicker portion 14 on the circumferential wall 13 of the protective cover 1 is in cross-section approximately rectangular and is surrounded without play and positive lockingly by the depression 15 of the handle 2 having a matching shape. Transversely thereto, the screw 38 is screwed in so that additionally in all directions a spatially fixed attachment of the line part 12 of the handle 2 is provided on the circumferential wall 13. It is also possible to provide a purely positive-locking attachment of the handle 2, for example, on the thicker portion 14, on the steps 17 (FIG. 3), and/or the openings 8 (FIG. 2). It can also be expedient to provide for a positive-locking attachment of the handle additional fastening elements or fastening locations as integrally cast parts of the protective cover.

Figure 11:
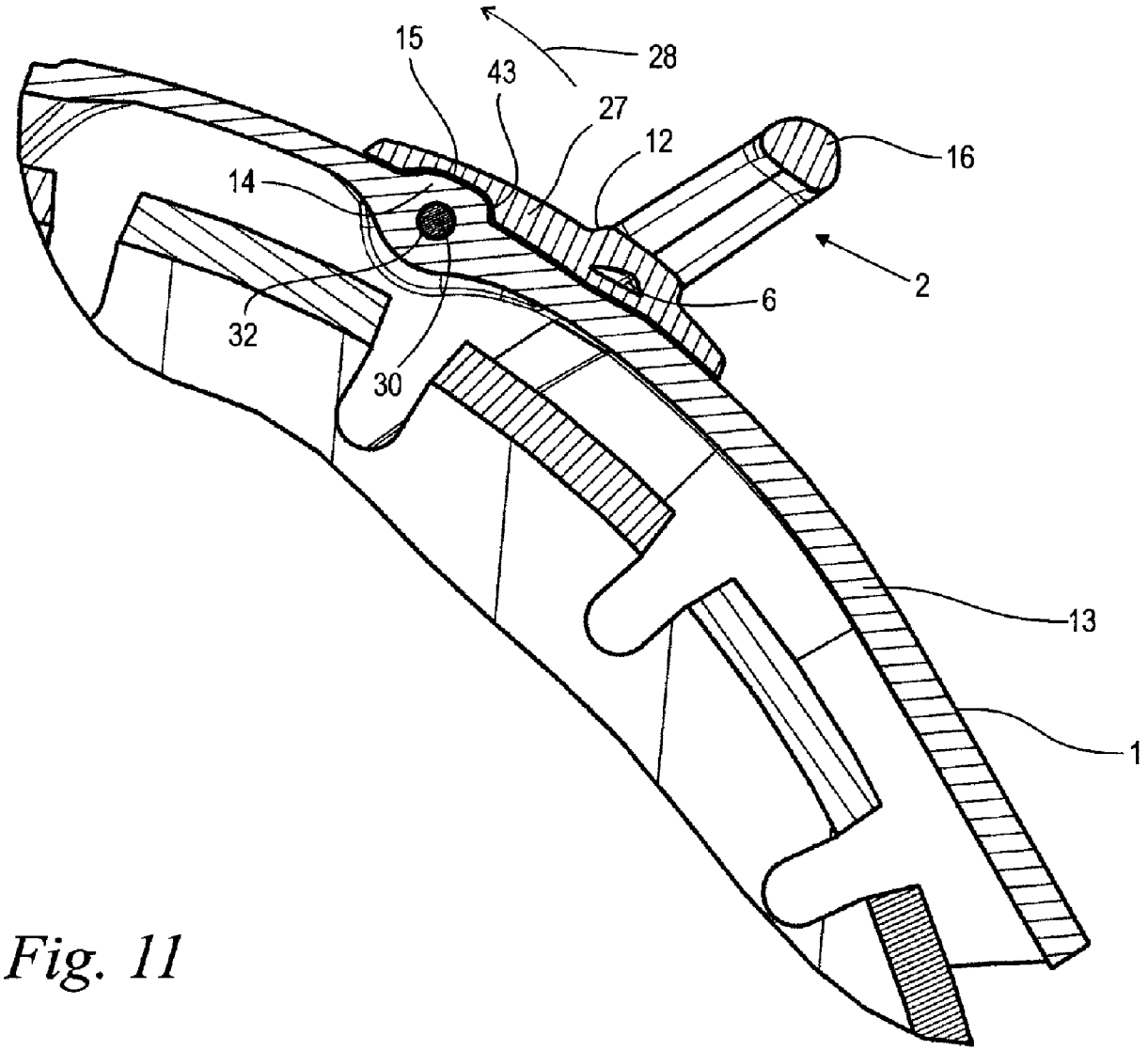
FIG. 11 is a longitudinal section illustration of a detail of the grip area of the protective cover according to FIG. 1 with details regarding the positive-locking attachment of the handle on the circumferential wall.

FIG. 11 shows a longitudinal section view of the arrangement according to FIG. 10 in the area of the bow 16. The contact section 27 of the handle 2 is provided with a concave depression 15 that is engaged in a flush arrangement by the thicker portion 14 of the circumferential wall 13 of the protective cover 1. The thicker portion 14 and the matchingly shaped depression 15 are provided with a flank 43 whose angled position is such that a positive-locking connection between the handle 2 and the circumferential wall 13, relative to the pivot direction 28, is provided. For additional fastening in this area a screw connection is provided in which a screw 30 is passed through the screw hole 32 of the thicker portion 14. The screw hole 32 is positioned approximately on the centerline of the illustrated section view through the circumferential wall 13. Starting at the screw hole 32, the material of the thicker portion 14 is uniformly distributed about the screw hole 32 for excellent force introduction so that the thicker portion 14, beginning at the screw hole 32 or the center line 31 of the circumferential wall, extends radially outwardly and inwardly.

Figure 12:
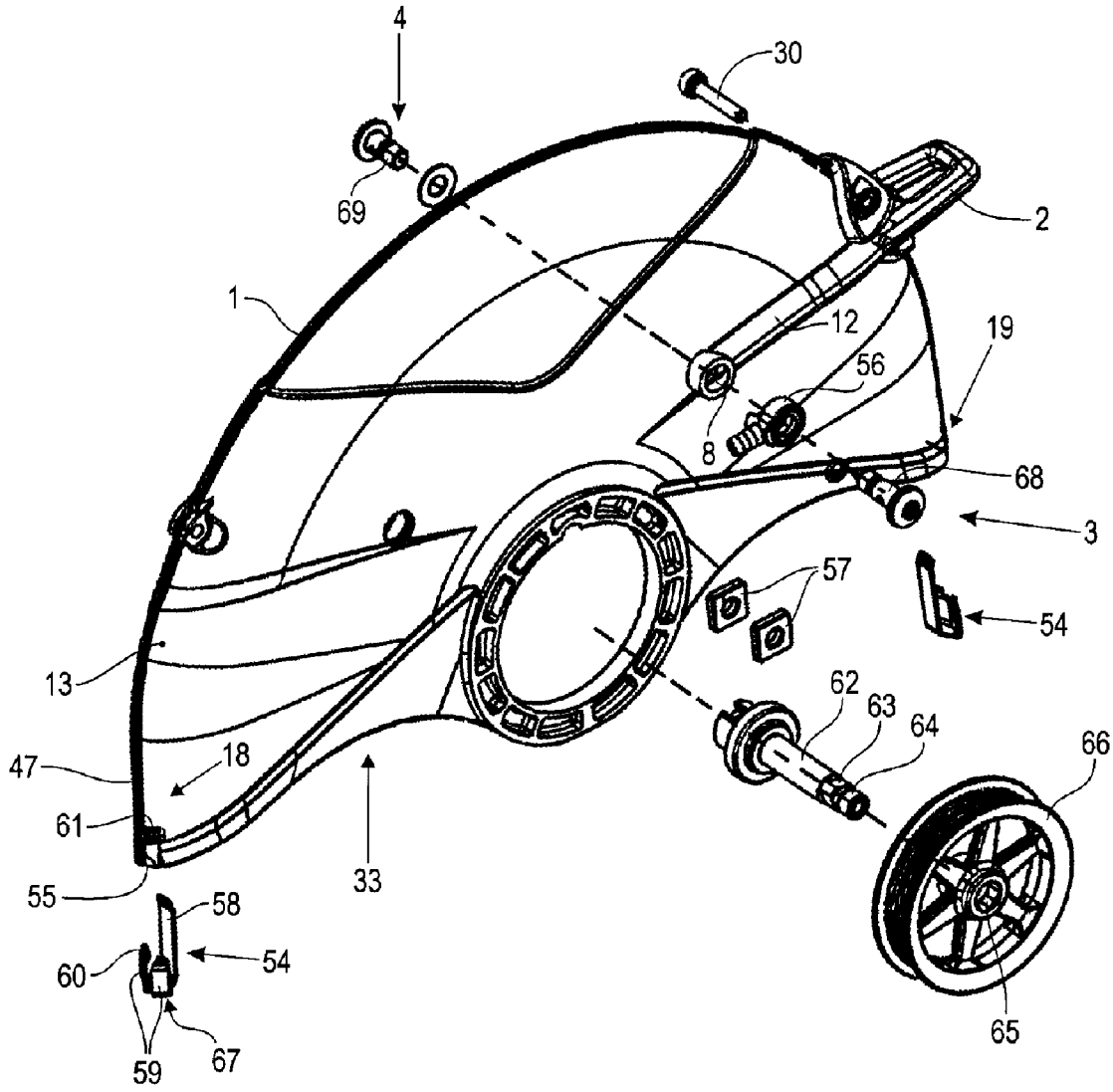
FIG. 12 is a perspective exploded view of a protective cover according to the invention with a wear protection in the form of a separate sheet steel part provided on both sides.

FIG. 12 shows a perspective exploded view of a further embodiment of the protective cover 1 according to the invention; here, the handle 2 with its line part 12 is placed like a fork onto the protective cover. A screw 38 arranged in the axial direction as well as the two injection nozzles 3, 4 are provided for attachment. The injection nozzles 3, 4 are passed through openings 8 from the exterior to the interior wherein in the case of the injection nozzle 3 a line connector 56 is interposed. The injection nozzles 3, 4 are hollow screws 68, 69 with a thread on the end positioned in the interior 33. In the interior 33 of the protective cover 1, the two injection nozzles 3, 4 are screw-connected with the aid of threaded base plates 57.

The circumferential wall 13 of the protective cover 1 is provided in its entry area 18 and also in the exit area 19 with a wear protection 54, respectively, that is embodied as a separate part. The arrangement of the wear protection 54 on both sides enables a reverse mounting of the protective cover 1 in such a way that the illustrated exit area 19 becomes the entry area 18 and vice versa.

The wear protection 54 is manufactured of sheet steel and comprises a sheet steel strip 58 that, in the mounted state, extends spatially limited across the entry area 18 of the circumferential wall 13 on the side facing the interior 33. On the opposed outer side of the circumferential wall 13, a depression 61 is provided in the entry area 18 on both sides of the alignment mark 47, respectively; the depression 61 serves for providing a snap-on attachment of the wear protection 54. For this purpose, the wear protection 54 has two spring tabs 59 that are turned relative to one another about their longitudinal axis and have a locking tongue 60 at their ends. In the mounted state, the looking tongues 16 engage the depressions 61 by snapping into place in an elastically springy fashion so that the wear protection 54 is attached in the area of the circumferential wall 13. A bottom section 67 of the wear protection 54 engages a leading edge 55 of the circumferential wall 13 adjoining the entry area 18. The leading edge 55 and the side of the entry area 18 facing the interior 33 are thus covered by the wear protection 54 and are protected against abrasion.

The sheet steel strip 58, the bottom section 67, and the two spring tabs 59 with the locking tongues 16 are formed as a unitary part of elastically springy sheet steel. The slanted position of the spring tabs relative to one another and relative to the sheet steel strip 58 provides in all spatial directions an effective three-point support. The spacing between the two spring tabs 59 is selected such that the alignment mark 47 in the mounted state projects from between the two spring tabs 59 and remains visible to the user. The exit area 19 with the wear protection 54 arranged thereat is designed in the same way.

In a schematic illustration, the drive shaft 62 for the cutting wheel 24 (FIG. 1) is illustrated; in the illustrated embodiment, it has an integral outer polygon 63 that is adjoined in the axial direction by a threaded section 64. The outer polygon 63 is embodied in the illustrated embodiment as a triangle. It is also possible to employ different polygon shapes, for example, a square quadrangle or a star-shaped groove arrangement. A pulley 66 as a part of the illustrated belt drive 25 in FIG. 1 is provided for mounting on the drive shaft 62 and has an inner polygon 65 that matches geometrically the outer polygon 63. In the mounted state, the inner polygon 65 surrounds without play the outer polygon 63 and provides torque transmission between the pulley 66 and the drive shaft 62. For axial attachment a nut, not illustrated, is screwed onto the threaded section 64 and secures the pulley 66 on the drive shaft 62.

With regard to other features and reference numerals, the embodiment according to FIG. 12 is identical to that of the preceding Figures.

While specific embodiments of the invention have been shown and described in detail to illustrate the inventive principles, it will be understood that the invention may be embodied otherwise without departing from such principles.

What is claimed is:

1. A protective cover for a cutting wheel of a hand-held cut-off machine driven by an internal combustion engine, the protective cover comprising:

a circumferential wall;

two opposed sidewalls adjoining the circumferential wall;

wherein the circumferential wall and the two sidewalls are a monolithic component made of cast light metal;

wherein the circumferential wall in a circumferential direction has at least over sections thereof a first integral thicker portion;

wherein the two sidewalls are thinner than the first integral thicker portion.

2. The protective cover according to claim 1, composed of diecast magnesium.

3. The protective cover according to claim 1, wherein the circumferential wall has an entry area and a central area arranged downstream of the entry area in the circumferential direction, wherein the entry area is thicker than the central area.

4. The protective cover according to claim 1, wherein the first integral thicker portion projects from a contour of the circumferential wall into an interior of the protective cover.

5. The protective cover according to claim 4, wherein the first integral thicker portion curves convexly into the interior.

6. The protective cover according to claim 1, wherein the first integral thicker portion is curved out of the contour of the circumferential wall to the exterior.

7. The protective cover according to claim 6, wherein the first integral thicker portion forms an alignment mark for the cutting wheel.

8. The protective cover according to claim 1, wherein the two sidewalls converge in a radial direction at least with sections thereof at a slant angle toward the circumferential wall.

9. The protective cover according to claim 8, wherein the two sidewalls each have a curved area adjoining the circumferential wall, wherein the curved area has a radius of curvature that decreases in the radial direction.

10. The protective cover according to claim 9, wherein the two sidewalls and the circumferential wall, viewed in a radial cross-section, have a flowing transition into one another.

11. The protective cover according to claim 9, wherein the two sidewalls and the circumferential wall, viewed in a radial cross-section, have an approximately elliptical contour.

12. The protective cover according to claim 1, wherein the circumferential wall has a second integral thicker portion that projects radially outwardly.

13. The protective cover according to claim 12, wherein the two sidewalls have steps extending transversely to a vertical direction that extends from the hub area to the circumferential wall.

14. The protective cover according to claim 13, wherein a first one of the steps extends at least approximately radially outwardly toward the second integral thicker portion.

15. The protective cover according to claim 1, wherein a spacing between the two sidewalls tapers beginning at a hub area of the protective cover up to the circumferential wall.

16. The protective cover according to claim 1, wherein a first one of the two sidewalls has an integral ring-shaped fastening flange.

17. The protective cover according to claim 16, wherein the fastening flange has window-shaped depressions distributed in a circumferential direction of the fastening flange.

18. The protective cover according to claim 16, wherein the fastening flange has a rounded transition into the first one of the two sidewalls.

19. The protective cover according to claim 16, wherein the fastening flange passes with an elliptical contour into the first one of the sidewalls.

20. The protective cover according to claim 1, wherein at least one fastening element for positive-lockingly attaching a handle is integrally formed by casting on the protective cover.

21. The protective cover according to claim 20, wherein the at least one fastening element is a second integral thicker portion on the circumferential wall that projects radially outwardly from the circumferential wall or the at least one fastening element is an opening in one of the two sidewalls.

22. The protective cover according to claim 1, wherein at least a partial area of a surface of the protective cover facing an interior of the protective cover has an inner coating applied by an electrochemical process.

23. The protective cover according to claim 1, comprising a separate wear protection attached to an entry area of the circumferential wall.

24. The protective cover according to claim 23, wherein the separate wear protection is arranged on a side of the circumferential wall facing an interior of the protective cover and surrounds a leading edge adjoining the entry area.

25. The protective cover according to claim 23, wherein the separate wear protection is composed of sheet steel and is connected elastically springy in the area of the circumferential wall by snapping into place.

* * * * *